US007907154B2

(12) United States Patent
Rykowski et al.

(10) Patent No.: US 7,907,154 B2
(45) Date of Patent: Mar. 15, 2011

(54) METHOD AND APPARATUS FOR ON-SITE CALIBRATION OF VISUAL DISPLAYS

(75) Inventors: Ronald F. Rykowski, Woodinville, WA (US); Richard E. Albrecht, Chapel Hill, NC (US)

(73) Assignee: Radiant Imaging, Inc., Duvall, WA (US)

( * ) Notice: Subject to any disclaimer, the term of this patent is extended or adjusted under 35 U.S.C. 154(b) by 1253 days.

(21) Appl. No.: 10/455,146

(22) Filed: Jun. 4, 2003

(65) Prior Publication Data

US 2004/0246273 A1 Dec. 9, 2004

(51) Int. Cl.
*G09G 5/10* (2006.01)

(52) U.S. Cl. ..... 345/690; 345/1.1

(58) Field of Classification Search ..... 345/1.1–1.3, 345/903, 690; 348/179–191, 650, 655, 807
See application file for complete search history.

(56) References Cited

U.S. PATENT DOCUMENTS

| | | | | |
|---|---|---|---|---|
| 4,379,292 | A * | 4/1983 | Minato et al. | 345/603 |
| 4,825,201 | A * | 4/1989 | Watanabe et al. | 345/2.1 |
| 4,875,032 | A * | 10/1989 | McManus et al. | 345/603 |
| 5,479,186 | A * | 12/1995 | McManus et al. | 345/11 |
| 5,563,621 | A * | 10/1996 | Silsby | 345/43 |
| 6,020,868 | A * | 2/2000 | Greene et al. | 345/88 |
| 6,243,059 | B1 * | 6/2001 | Greene et al. | 345/88 |
| 6,459,425 | B1 | 10/2002 | Holub et al. | |
| 6,491,412 | B1 | 12/2002 | Bowman et al. | |
| 6,552,706 | B1 * | 4/2003 | Ikeda et al. | 345/96 |
| 6,559,826 | B1 | 5/2003 | Mendelson et al. | |
| 6,611,241 | B1 * | 8/2003 | Firester et al. | 345/1.3 |
| 6,677,958 | B2 * | 1/2004 | Cottone et al. | 345/589 |
| 6,704,989 | B1 * | 3/2004 | Lutz et al. | 29/428 |
| 6,822,802 | B2 * | 11/2004 | Nakano et al. | 359/637 |
| 7,012,633 | B2 | 3/2006 | Jenkins | |
| 7,161,558 | B1 | 1/2007 | Eidem et al. | |
| 2003/0016198 | A1 * | 1/2003 | Nagai et al. | 345/83 |
| 2003/0156073 | A1 * | 8/2003 | Van Zon | 345/1.1 |
| 2004/0066515 | A1 | 4/2004 | Ott | |
| 2004/0179208 | A1 | 9/2004 | Hsu | |

FOREIGN PATENT DOCUMENTS

| | | |
|---|---|---|
| JP | 05-064103 | 3/1993 |
| JP | 2001-222259 | 8/2001 |
| JP | 2003-099003 | 4/2003 |

OTHER PUBLICATIONS

Jenkins, David R., et al, "Digital imaging colorimeter for fast measurement of chromaticity coordinate and luminance uniformity of displays,"Jan. 23, 2001, 12 pages, Radiant Imaging, Chapel Hill, NC; US.

Ohno, Yoshi, "CIE Fundamentals for Color Measurements," 2000, pp. 1-6, IS&T NIP16 Conference, National Institute of Standards and Technology, Gaithersberg, MD, US.

Ohno, Yoshihiro, et al, "Four-Color Matrix Method for Correction of Tristimulus Colorimeters," 1997, pp. 1-5, Proc., IS&T Fifth Color Imaging Conference, 301-305, National Institute of Standards and Technology, Gaithersberg, MD, US.

* cited by examiner

*Primary Examiner* — Sumati Lefkowitz
*Assistant Examiner* — Rodney Amadiz
(74) *Attorney, Agent, or Firm* — Perkins Coie LLP

(57) ABSTRACT

The present disclosure provides methods and apparatuses for on-site calibration of a visual display sign. In one exemplary implementation of the invention, an imaging device captures image data from a visual display sign. The imaging device can include a CCD digital camera and optics for long-range imaging. The captured image data is sent to an interface that compiles the data. The interface then calculates correction factors for the image data that may be used to achieve target color and brightness values for the image data. The interface then uploads the adjusted image data back to the visual display sign.

25 Claims, 6 Drawing Sheets

METHOD AND APPARATUS FOR ON-SITE CALIBRATION OF VISUAL DISPLAYS

TECHNICAL FIELD

The present invention generally relates to brightness and color measurement. More particularly, several aspects of the present invention are related to methods and apparatuses for measuring and calibrating the output from large, visual display signs.

BACKGROUND

Visual display signs have become commonplace in sports stadiums, arenas, and public forums throughout the world. The signs are typically very large, often measuring several hundred feet in size. Because of their immense size, the signs must be assembled and installed on-site using a series of smaller panels, which are themselves further comprised of a series of modules. The modules are internally connected to each other by way of a bus system. A computer or central control unit sends graphic information to the different modules, which then display the graphic information as images and text on the sign.

Each module in turn is made up of hundreds of individual light-emitting elements, or "pixels." In turn, each pixel is made up of a plurality of light-emitting points, e.g., one red, one green, and one blue. The light-emitting points are termed "subpixels." During calibration of each module, the color and brightness of each pixel is adjusted so that the pixels can display a particular color. The adjustment to each pixel necessary to create a color is then stored in software or firmware that controls the module.

Although each module is calibrated before leaving the factory, the individual pixels often do not exactly match each other in terms of brightness or color because of manufacturing tolerances. Furthermore, the electronics powering the various modules have tolerances that affect the power and temperature of the subpixels, which in turn affect the color and brightness of the individual pixels. As the sign ages, the light output of each subpixel may degrade. Because the degradation is not uniform for each color of subpixel, or even for each subpixel of the same color, the uniformity and color point of the sign will degrade over time. This can cause color shifts, visible edges around individual screen modules, and pixel-to-pixel non-uniformity.

Accordingly, the assembled visual display sign needs to be recalibrated periodically to maintain the ability to display colors clearly, uniformly, and accurately. However, the immense size of most visual display signs makes recalibration of the sign in a testing center impossible. Likewise, it is not cost-effective or practical to disassemble the sign in the field and bring in the individual modules to a testing center for recalibration.

On-site measurement and calibration provides its own challenges. For example, at a typical American football field the scoreboard may be 200 meters from a suitable measurement location. The requirement to measure subpixels that may only be a few millimeters in size from a distance of 200 meters requires high-powered, specialized optics. Another problem with on-site measurement is the extraction and management of the massive amount of data that must be collected, stored, and used for calculation of new correction factors. A typical display sign will have well over two million subpixels that must each be measured and recorded.

DETAILED DESCRIPTION

In the following description, numerous specific details are provided, such as the identification of various system components, to provide a thorough understanding of embodiments of the invention. One skilled in the art will recognize, however, that the invention can be practiced without one or more of the specific details, or with other methods, components, materials, etc. In still other instances, well-known structures, materials, or operations are not shown or described in detail to avoid obscuring aspects of various embodiments of the invention.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1:
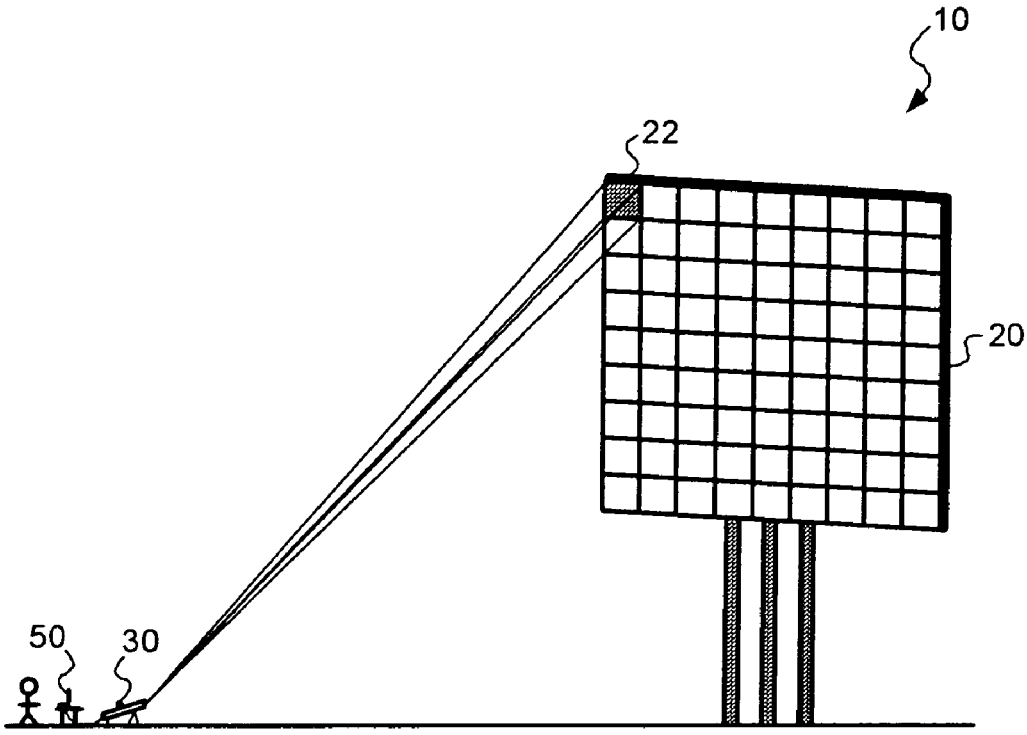
FIG. 1 is an isometric view of an on-site visual display calibration system in accordance with one embodiment of the invention.

FIG. 1 is an isometric view of an on-site visual display calibration system 10 in accordance with one embodiment of the invention. The system 10 is configured to perform on-site correction of brightness and color of visual display signs, such as scoreboards in sports stadiums. In general, the system 10 includes an imaging device 30, a visual display sign 20, and an interface 50.

The imaging device 30 is positioned a distance from the sign 20 and configured to capture a series of images from an imaging area 22 on the sign 20. The captured image data is transferred from the imaging device 30 to an interface 50, which is operatively coupled to both the imaging device 30 and the sign 20. The interface 50 compiles and manages the image data from each imaging area 22, performs a series of calculations to determine the appropriate correction factors that should be made to the image data, and then stores the data. After capturing the data for imaging area 22, the imaging device 30 is repositioned to capture image data from a new imaging area on the sign 20. This process is repeated until images from the entire sign 20 have been obtained. After collection of all the necessary data, the processed correction data is then uploaded from the interface 50 to the sign 20 and used to recalibrate the display of the sign 20.

The imaging device 30 also incorporates specialized optics that are necessary for high-resolution long-distance imaging. In one embodiment, the imaging device 30 is capable of measuring subpixels, which are only a few millimeters in size, from a distance of more than 200 meters.

The interface 50, which is operably coupled to both the imaging device 30 and the sign 20, is configured to manage the data that is collected, stored, and used for calculation of new correction factors that will be used to recalibrate the sign 20. A typical XGA-resolution visual display sign will have well over two million subpixels, each of which must be measured and recorded. The interface 50 controls the sign 20, automates the operation of the imaging device 30, and writes all the data into a database. The software is flexible enough to properly find and measure each subpixel, even though alignment of the camera and screen is not ideal. Further, the software in the interface 50 is adaptable to various sizes and configurations of visual display signs.

It should be understood that the division of the on-site calibration system 10 into three components is for illustrative purposes only and should not be construed to limit the scope of the invention. Indeed, the various components may be further divided into subcomponents, or the various components and functions may be combined and integrated. A detailed discussion of the various components and features of the on-site visual display calibration system 10 follows.

Figure 2:
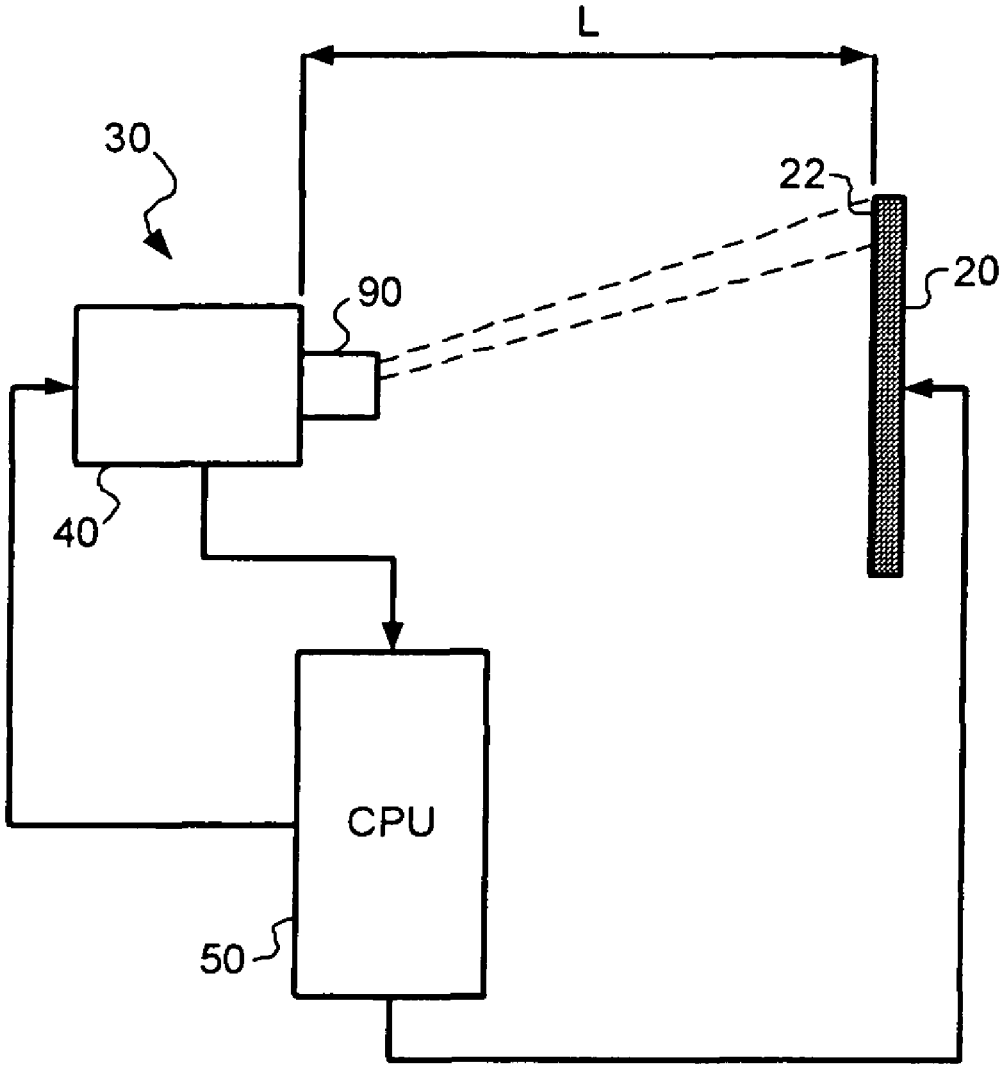
FIG. 2 is a block diagram of the on-site visual display calibration system of FIG. 1.

FIG. 2 is a block diagram of the on-site visual display calibration system 10 described above with respect to FIG. 1. The imaging device 30 can include a digital camera 40 and a lens 90 to allow for the resolution of each subpixel within the imaging area 22 of the sign 20. In one embodiment, the digital camera 40 can be a Charge Coupled Device (CCD) camera. A suitable CCD digital color camera is the ProMetric™ Light and Measurement System, which is commercially available from the assignee of the present invention, Radiant Imaging, 15321 Main St. NE, Suite 310, Duvall, Wash. Optionally, in another embodiment a Complementary Metal Oxide Semiconductor (CMOS) camera may be used.

In addition to the digital camera 40, the imaging device 30 can also include a lens 90. In one embodiment, the lens 90 comprises a reflecting telescope operably coupled to the digital camera to enable the camera 40 to have sufficient resolution to resolve the imaging area 22 on the sign 20. In further embodiments, a variety of lenses may be used, so long as the particular lens provides sufficient resolution for the digital camera 40 to adequately capture image data within the imaging area 22.

The imaging device 30 is positioned at a distance L to the sign 20. The distance between the imaging device 30 and the sign 20 will vary depending on the screen size. In one embodiment, the imaging device 30 is positioned at a distance that is similar to the typical viewing distance of the sign 20. For example, in a sports stadium, the imaging device 30 may be placed in a seating area that is directly facing toward the sign 20. In other embodiments, however, the distance L can vary.

The on-site calibration system 10 further includes the interface 50. The interface 50 comprises image software to control the imaging device 30 as well as measurement software to find each subpixel in an image and extract the brightness and color data from the subpixel. In one embodiment, the interface 50 can be a personal computer with software for camera control, image data acquisition, and image data analysis. Optionally, in other embodiments various devices capable of operating the software can be used, such as handheld computers. Suitable software for the interface 50, such as ProMetric™ v. 7.2, is commercially available from the assignee of the present invention, Radiant Imaging, 15321 Main St. NE, Suite 310, Duvall, Wash.

The interface 50 also includes a database. The database is used to store data for each subpixel, including brightness, color coordinates, and calculated correction factors. In one embodiment, the database is a Microsoft® Access database designed by the assignee of the present invention, Radiant Imaging, 15321 Main St. NE, Suite 310, Duvall, Wash. The stored correction data is then uploaded to the module control system, which sends module control commands to the sign 20.

Figure 3:
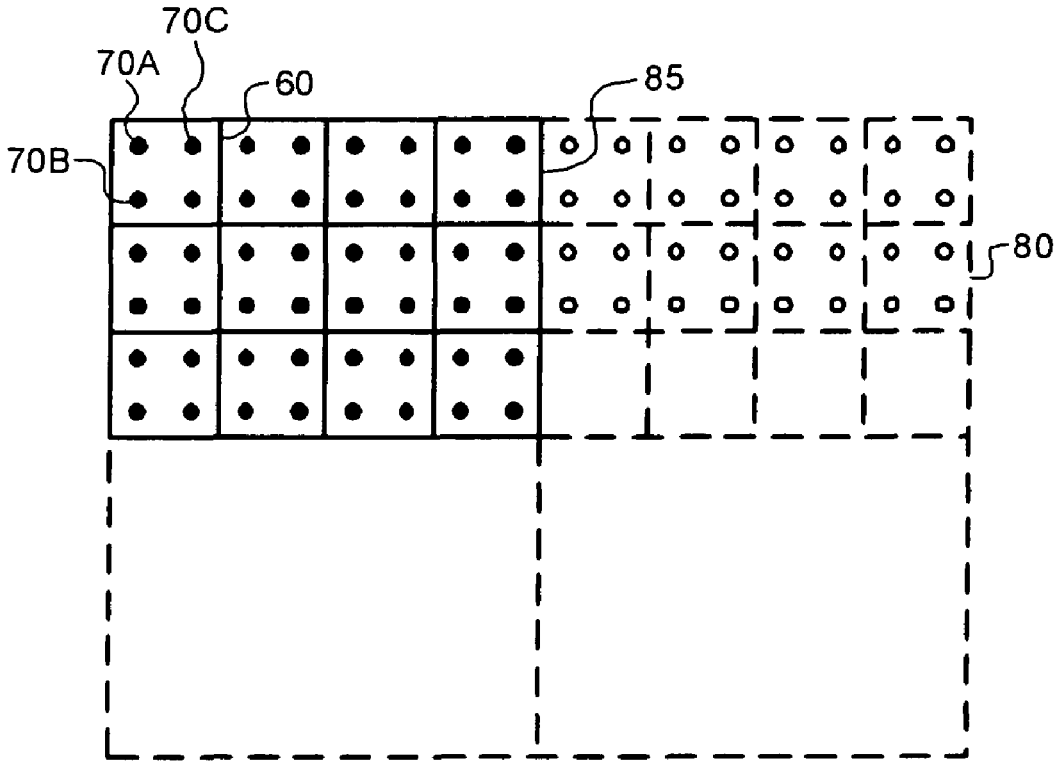
FIG. 3 is an enlarged isometric view of a panel of the visual display sign of FIG. 1.

FIG. 3 is an enlarged isometric view of a portion of the visual display sign 20. In one embodiment, the visual display sign 20 being calibrated is a large electronic scoreboard, commonplace in sports stadiums throughout the world. In other embodiments, any variety of visual display signs that incorporate light-emitting diodes may be calibrated using the on-site calibration system 10.

The sign 20 is assembled using a series of smaller panels 80, which are themselves further comprised of a series of modules 85. Each module 85 is made up of hundreds of individual light-emitting elements 60, or "pixels." In turn, each pixel 60 is made up of three light-emitting points, subpixels 70*a*-70*c*. In one embodiment, the subpixels 70*a*-70*c* are red, green, and blue respectively. In other embodiments, however, the number of subpixels may be more than three. For example, some pixels may have four subpixels, e.g., two green subpixels, one blue subpixel, and one red subpixel. Furthermore, in some embodiments, the red, green, and blue (RGB) color space may not be used. Rather, a different color space can serve as the basis for processing and display of color images on the sign 20. For example, the subpixels 70*a*-70*c* may be cyan, magenta, and yellow respectively.

Figure 4:
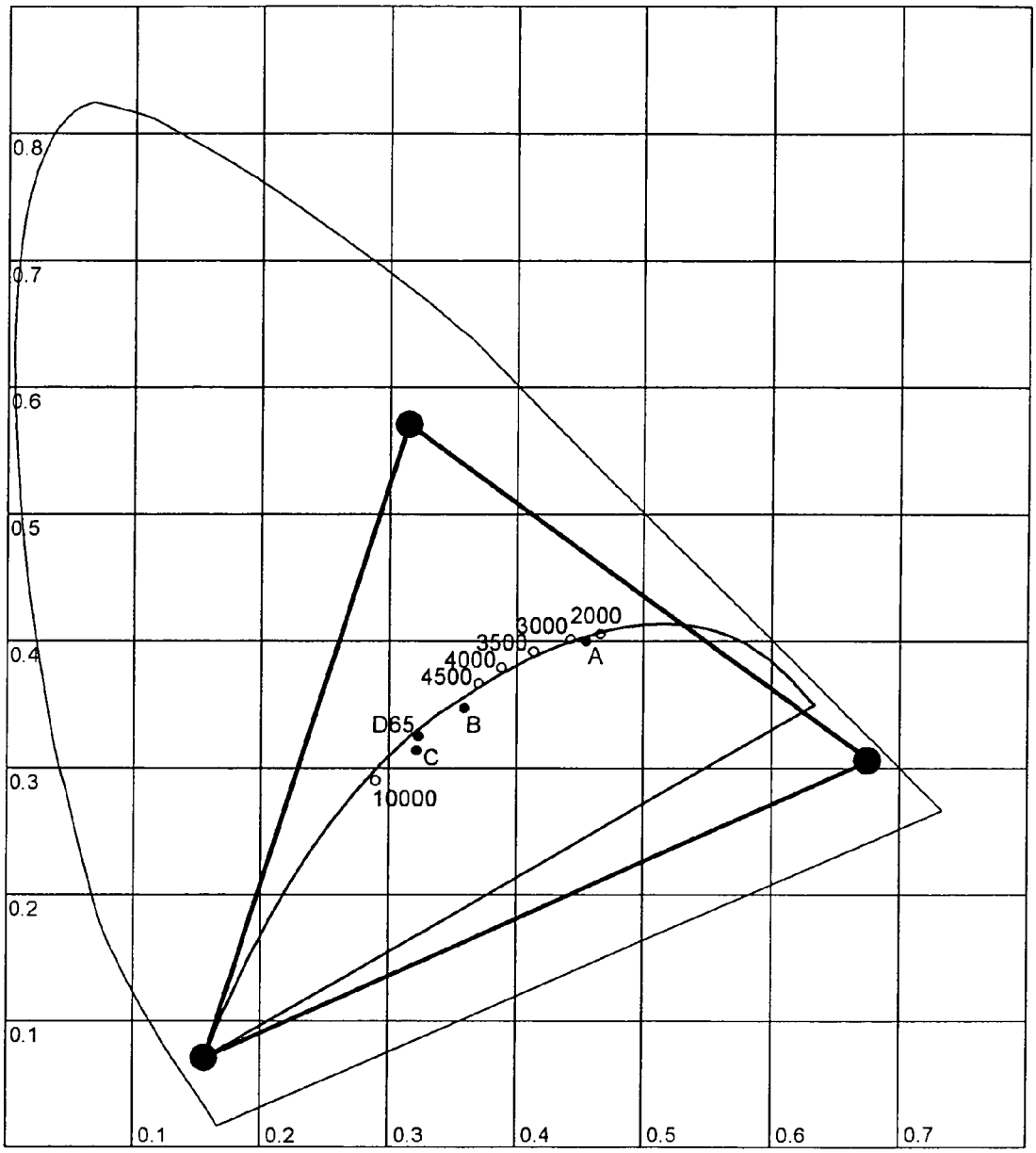
FIG. 4 is a diagram of a color gamut triangle.

The brightness level of each subpixel 70*a*-70*c* in the sign 20 can be varied. Accordingly, the additive primary colors represented by the red subpixel 70*a*, the green subpixel 70*b*, and the blue subpixel 70*c*, can be selectively combined to produce the colors within the color gamut defined by a color gamut triangle, as shown in FIG. 4. For example, when only "pure" red is displayed, the green and blue subpixels may be turned on slightly to achieve a specific chromaticity for the red color.

Calibration of the sign 20 requires highly accurate measurements of the color and brightness of each subpixel, often referred to as a light emitting diode (LED). Typically, the accuracy required for measurement of the individual subpixels can only be achieved with a spectral radiometer. Subpixels are particularly difficult to measure accurately with a colorimeter because they are narrow-band sources, and a small deviation in the filter response at the wavelength of a particular subpixel can result in significant measurement error. Colorimeters rely on color filters that can have small imperfection in spectral response. In the illustrated embodiment, however, the imaging device 30 utilizes a colorimeter. The problem with small measurement errors has been overcome by correcting for the errors using software in the interface 50 to match the results of a spectral radiometer. For a detailed overview of the software corrections, see "Digital Imaging Colorimeter for Fast Measurement of Chromaticity Coordinate and Luminance Uniformity of Displays", Jenkins et al., Proc. SPIE Vol. 4295, Flat Panel Display Technology and Display Metrology II, Edward F. Kelley Ed., 2001. The article is incorporated herein by reference.

Figure 5:
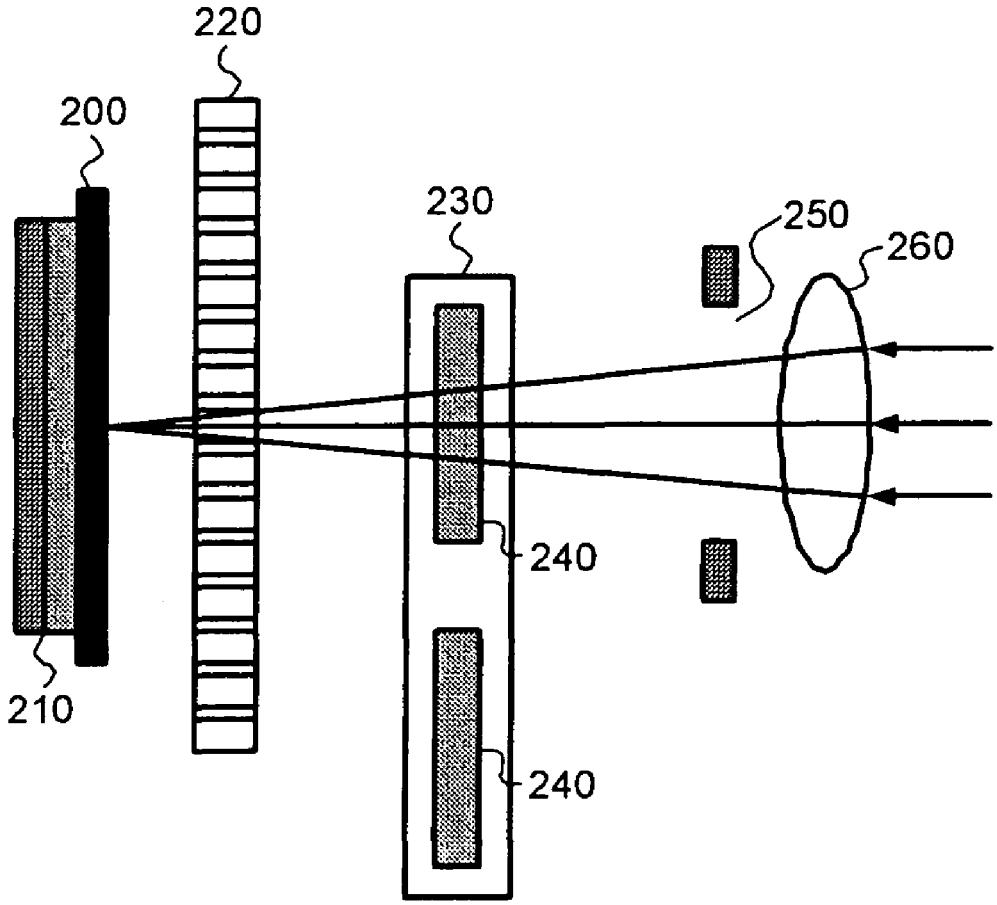
FIG. 5 is a detailed schematic view of a CCD digital color camera in accordance with one embodiment of the invention.

FIG. 5 is a detailed schematic view of the CCD digital camera 40 (FIG. 2). The camera 40 can include an imaging lens 260, lens aperture 250, color correction filters 240 in a computer-controlled filter wheel 230, mechanical shutter 220, and a CCD imaging array 200. In operation, light from the sign 20 (FIG. 2) enters the imaging lens 260 of the camera 40. The light then passes through the lens aperture 250, through a color correction filter 240 in a computer-controlled filter wheel 230, and through a mechanical shutter 220 before being imaged onto the imaging array 200.

A two-stage Peltier cooling system using two back-to-back thermoelectric coolers 210 (TECs) operates to control the temperature of the CCD imaging array 200. The cooling of the CCD imaging array 200 within the camera 40 allows it to operate at 14-bits analog to digital conversion with approximately 2 bits of noise (i.e., 4 grayscale units of noise out of a possible 16,384 maximum dynamic range). A 14-bit CCD implies that up to $2^{14}$ or 16,384 grayscale levels of dynamic range are available to characterize the amount of light incident on each pixel.

The CCD imaging array 200 comprises a plurality of light sensitive cells or pixels that are capable of producing an electrical charge proportional to the amount of light they receive. The pixels in the CCD imaging array 200 are arranged in a two-dimensional grid array. The number of pixels in the horizontal or x-direction, and the number of pixels in the vertical or y-direction, constitutes the resolution of the CCD imaging array 200. For example, in one embodiment the CCD imaging array 200 has 1536 pixels in the x-direction and 1024 pixels in the y-direction. Thus, the resolution of the CCD imaging array 200 is 1,572,864 pixels, or 1.6 megapixels.

The resolution of the CCD imaging array 200 must be sufficient to resolve the imaging area 22 (FIG. 2) on the visual display sign 20 (FIG. 2). In one embodiment, the resolution of the CCD imaging array 200 is such that 50 pixels on the CCD imaging array 200 correspond to one subpixel, e.g., subpixel 70*a* (FIG. 3), on the sign 20 (FIG. 2). By way of example, in one embodiment the CCD digital camera 40 of the imaging device 30 (FIG. 2) has a resolution of 1,572,864 pixels. Assuming that fifty pixels of resolution from the CCD digital camera 40 corresponds to one subpixel on the sign 20, then the CCD digital camera 40 can capture data from 31,457 subpixels on the sign 20 (1,572,864 pixels from the camera/50) in an single captured image. In other embodiments, the correlation between the resolution of the CCD imaging array 200 and the visual display sign 20 can vary between thirty to seventy pixels on the CCD imaging array 200 corresponding to one subpixel on the visual display sign 20. Each subpixel captured by the CCD imaging array 200 can be characterized by its color value, typically expressed as chromaticity (Cx, Cy), and its brightness, typically expressed as luminance L.

Figure 6:
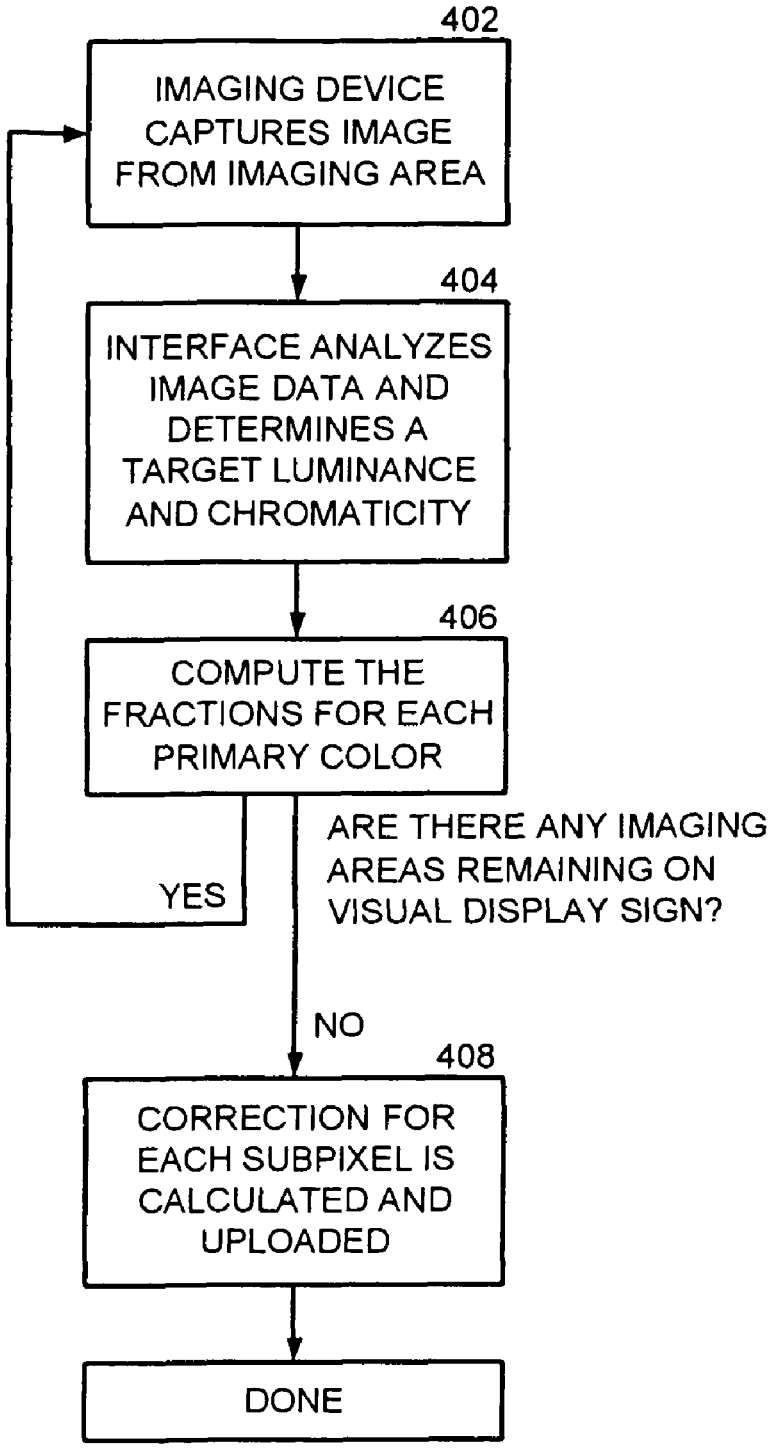
FIG. 6 is a flow diagram illustrating a method of the present invention.

The method of the present invention is shown in FIG. 6. Beginning at box 402, the imaging device scans a first imaging area on the visual display sign and captures an image. The size of the imaging area, as discussed previously, depends on the resolution of the imaging device. The required image data can be obtained by measuring the three light sources (red, green, and blue) at nominal intensity independently for both luminance and chromaticity coordinates. The luminance and chromaticity coordinates for light source n are $L_n$, $Cx_n$ and $Cy_n$.

After the image is captured, at box 404 the image data is sent to the interface. The interface is programmed to calculate a three by three matrix of values that indicate some fractional amount of power to turn on each subpixel for each primary color. A sample matrix is displayed below:

Fractional values for each subpixel

| Primary color | Red | Green | Blue |
|---|---|---|---|
| Red | 0.60 | 0.10 | 0.05 |
| Green | 0.15 | 0.70 | 0.08 |
| Blue | 0.03 | 0.08 | 0.75 |

For example, when red is displayed on the screen, the screen will turn on each red subpixel at 60% power, the green subpixels at 10% power, and the blue subpixels at 5% power. The following discussion details how this matrix is determined.

The goal is to determine the relative luminance levels of three given light sources, e.g., red, green and blue subpixels, to produce specified target chromaticity coordinates Cx and Cy. The first step is to compute the luminance target for each color. This can be done using the following equations, where $L_1$, $L_2$, and $L_3$ are set to 1 and the source chromaticity values are just the target chromaticity values for each primary color. The following equations are used to calculate tristimulus values for each light source:

$$Cx_n \equiv \frac{X_n}{X_n + Y_n + Z_n}, \quad Cy_n \equiv \frac{Y_n}{X_n + Y_n + Z_n}. \text{ or}$$

$$Y_n = L_n,\ X_n = \frac{Cx_n}{Cy_n} \cdot Y_n,\ \ Z_n = \frac{1 - Cx_n - Cy_n}{Cy_n} \cdot Y_n$$

Next, calculate tristimulus values for the target chromaticity coordinates:

$$Cx_t \equiv \frac{X_t}{X_t + Y_t + Z_t}, \quad Cy_t \equiv \frac{Y_t}{X_t + Y_t + Z_t}. \text{ or}$$

$$Y_t = L_t,\ X_t = \frac{Cx_t}{Cy_t} \cdot Y_t,\ \ Z_t = \frac{1 - Cx_t - Cy_t}{Cy_t} \cdot Y_t$$

where the target luminance $L_t = L_1 + L_2 + L_3$.

The next step is to determine the fractional luminance levels of the three light sources. Colors can be produced by combining the three light sources at different illumination levels. This is represented by the following equations:

$$X_t = a \cdot X_1 + b \cdot X_2 + c \cdot X_3$$

$$Y_t = a \cdot Y_1 + b \cdot Y_2 + c \cdot Y_3$$

$$Z_t = a \cdot Z_1 + b \cdot Z_2 + c \cdot Z_3$$

Where a, b, and c are the fractional values of luminance produced by the source measured in the first step. For example, if a=0.5, then light source 1 should be turned on at 50% of the intensity measured in the first step to produce the desired color.

We can write the above system of equations as $$\begin{pmatrix} X_t \\ Y_t \\ Z_t \end{pmatrix} = A \cdot \begin{pmatrix} a \\ b \\ c \end{pmatrix} \text{ where } A = \begin{pmatrix} X_1 & X_2 & X_3 \\ Y_1 & Y_2 & Y_3 \\ Z_1 & Z_2 & Z_3 \end{pmatrix}$$

We can then solve for a, b and c as $$\begin{pmatrix} a \\ b \\ c \end{pmatrix} = A^{-1} \cdot \begin{pmatrix} X_t \\ Y_t \\ Z_t \end{pmatrix}$$

where $$A^{-1} = \frac{1}{Det(A)}\begin{pmatrix} Y_2Z_3 - Y_3Z_2 & X_3Z_2 - X_2Z_3 & X_2Y_3 - X_3Y_2 \\ Y_3Z_1 - Y_1Z_3 & X_1Z_3 - X_3Z_1 & X_3Y_1 - X_1Y_3 \\ Y_1Z_2 - Y_2Z_1 & X_2Z_1 - X_1Z_2 & X_1Y_2 - X_2Y_1 \end{pmatrix}$$

(by Cramer's Rule) and $Det(A)=X_1\cdot(Y_2Z_3-Y_3Z_2)-Y_1\cdot(X_2Z_3-X_3Z_2)+Z_1\cdot(X_2Y_3-X_3Y_2)$.

The calculated a, b and c fractions are the target luminance for each primary color.

At box 406, the next step is to compute the fractions for each primary color. Again, the same formulas as described above are applied. This time, however, the source luminance and chromaticity is that of each subpixel, as measured by the imaging device in box 402. The target is the chromaticity and luminance for each primary color, which was determined at box 404. The following equations are used to calculate tristimulus values for each light source:

$$Cx_n \equiv \frac{X_n}{X_n + Y_n + Z_n},\ Cy_n \equiv \frac{Y_n}{X_n + Y_n + Z_n}.\ \text{or}$$

$$Y_n = L_n,\ X_n = \frac{Cx_n}{Cy_n}\cdot Y_n,\ Z_n = \frac{1 - Cx_n - Cy_n}{Cy_n}\cdot Y_n$$

Next, calculate tristimulus values for the target chromaticity coordinates:

$$Cx_t \equiv \frac{X_t}{X_t + Y_t + Z_t},\ Cy_t \equiv \frac{Y_t}{X_t + Y_t + Z_t}.\ \text{or}$$

$$Y_t = L_t,\ X_t = \frac{Cx_t}{Cy_t}\cdot Y_t,\ Z_t = \frac{1 - Cx_t - Cy_t}{Cy_t}\cdot Y_t$$

where the target luminance $L_t=L_1+L_2+L_3$.

The next step is to determine the fractional luminance levels of the three light sources. Colors can be produced by combining the three light sources at different illumination levels. This is represented by the following equations:

$$X_t = a\cdot X_1 + b\cdot X_2 + c\cdot X_3$$

$$Y_t = a\cdot Y_1 + b\cdot Y_2 + c\cdot Y_3$$

$$Z_t = a\cdot Z_1 + b\cdot Z_2 + c\cdot Z_3$$

Where a, b, and c are the fractional values of luminance produced by the source measured in the first step. We can write the above system of equations as $$\begin{pmatrix} X_t \\ Y_t \\ Z_t \end{pmatrix} = A\cdot\begin{pmatrix} a \\ b \\ c \end{pmatrix} \text{ where } A = \begin{pmatrix} X_1 & X_2 & X_3 \\ Y_1 & Y_2 & X_3 \\ Z_1 & Z_2 & X_3 \end{pmatrix}$$

We can then solve for a, b and c as $$\begin{pmatrix} a \\ b \\ c \end{pmatrix} = A^{-1}\cdot\begin{pmatrix} X_t \\ Y_t \\ Z_t \end{pmatrix}$$

where $$A^{-1} = \frac{1}{Det(A)}\begin{pmatrix} Y_2Z_3 - Y_3Z_2 & X_3Z_2 - X_2Z_3 & X_2Y_3 - X_3Y_2 \\ Y_3Z_1 - Y_1Z_3 & X_1Z_3 - X_3Z_1 & X_3Y_1 - X_1Y_3 \\ Y_1Z_2 - Y_2Z_1 & X_2Z_1 - X_1Z_2 & X_1Y_2 - X_2Y_1 \end{pmatrix}$$

(by Cramer's Rule) and $Det(A)-X_1\cdot(Y_2Z_3-Y_3Z_2)-Y_1\cdot(X_2Z_3-X_3Z_2)+Z_1\cdot(X_2X_3-X_3Y_2)$.

Now, a, b and c represent the fractional luminance levels of the three light sources needed to produce a target color of (Cx, Cy) at the maximum luminance possible. This calculation is repeated three times, once for each color. This provides three sets of three a, b and c fractions, which are the components of the three by three matrix discussed above.

Note that if any of the values a, b, or c are negative, the desired chromaticity coordinate cannot be produced by any combination of the three light sources since it is outside the color gamut. A negative value would indicate a negative amount of luminance for a given subpixel, which of course can not occur. The above formulas, however, do not take this into account. Accordingly, two other fractions are set at levels that produce more light than is needed to hit the target luminance, and they must be reduced. This is done as follows:

TotalLuminance=*a**RedLuminance+
*b**GreenLuminance+*c**BlueLuminance

ScaleFactor=TotalLuminance/(*b**GreenLuminance+
*c**BlueLuminance)

*b*=*b**ScaleFactor

*c*=*c**ScaleFactor a=0

Note that ScaleFactor will always be less than 1 because TotalLuminance includes the negative value. Also note that although we do achieve the target luminance, the target chromaticity is not quite achieved in this case.

At box 408, the calculated correction determined above is uploaded from the interface to the firmware or software controlling the visual display sign. The visual display sign is then recalibrated using the new data for each subpixel.

One advantage of the foregoing embodiments of the on-site visual display calibration system is the efficiency and cost-effectiveness in recalibrating large visual display signs. It is impractical to disassemble the visual display sign in the field because of the sign's immense size. The on-site visual sign calibration system provides an effective way of recalibrating the visual display sign on-site without disassembling or in any way moving the sign.

Another advantage of the embodiments described above is the capability of the CCD digital camera to capture large amounts of data in a single image. For example, the two-dimensional array of pixels on the CCD imaging array is capable of capturing a large number of data points from the visual display sign in a single captured image. By capturing thousands, or even millions, of data points at once, the process of recalibrating the visual display sign is accurate and cost-effective.

While the invention is described and illustrated here in the context of a limited number of embodiments, the invention may be embodied in many forms without departing from the spirit of the essential characteristics of the invention. The illustrated and described embodiments are therefore to be considered in all respects as illustrative and not restrictive. Thus, the scope of the invention is indicated by the appended claims rather than by the foregoing description, and all changes which come within the meaning and range of equivalency of the claims are intended to be embraced therein.

We claim:

1. A method for calibrating a visual display sign, the method comprising:

(a) analyzing a visual display sign, the sign comprising an array of pixels and corresponding subpixels;

(b) locating and registering multiple subpixels of the visual display sign;

(c) determining a chromaticity value and a luminance value for each registered subpixel;

(d) converting the chromaticity value and luminance value for each registered subpixel to measured tristimulus values;

(e) converting a target chromaticity value and a target luminance value for a given color to target tristimulus values;

(f) calculating correction factors for each registered subpixel based on a difference between the measured tristimulus values and the target tristimulus values; and (g) sending the correction factors to the visual display sign.

2. The method of claim 1, further comprising:

(h) setting the visual display sign image to the color red;

(i) repeating steps (a) to (f); and (j) repeating steps (h) and (i) with the visual display sign image set to green, blue, and white.

3. The method of claim 1 wherein the subpixels are light-emitting diodes.

4. The method of claim 1 wherein the array of pixels comprises an array of modules, the modules including a plurality of light-emitting diodes.

5. The method of claim 1 wherein the array of pixels comprises one or more panels including a plurality of light-emitting diodes.

6. The method of claim 1 wherein the process in step (c) for determining the chromaticity value and luminance value for each subpixel includes the use of an imaging colorimeter.

7. The method of claim 1 wherein the process in step (g) for sending the correction factors to the visual display sign comprises uploading the corrected subpixel values to firmware and/or software controlling the visual display sign.

8. The method of claim 1 wherein steps (a) to (g) take place at the on-site location of the visual display sign.

9. The method of claim 1 wherein sending the correction factors to the visual display sign comprises calibrating the visual display sign with the adjusted subpixel values.

10. A method for calibrating a visual display sign, the method comprising:

(a) analyzing a portion of the visual display sign, the portion comprising an array of pixels and corresponding subpixels;

(b) locating and registering multiple subpixels within the array;

(c) determining a chromaticity and a luminance value for each registered subpixel within the array;

(d) storing the chromaticity and luminance value for each subpixel;

(e) repeating steps (a) to (d) for each portion of the visual display sign until all portions of the visual display sign have been analyzed;

(f) converting the chromaticity value and luminance value for each registered subpixel to measured tristimulus values;

(g) converting a target chromaticity value and a target luminance value for a given color to target tristimulus values;

(h) calculating correction factors for each subpixel based on a difference between the measured tristimulus values and the target tristimulus values;

(i) applying the correction factors to the stored chromaticity and luminance values for each subpixel; and (j) calibrating the visual display sign with the corrected subpixel values.

11. The method of claim 10, further comprising:

(k) setting the visual display sign to project the color red;

(l) repeating steps (a) to (i); and (m) repeating steps (k) and (l) with the visual display sign set to green, blue, and white.

12. The method of claim 10 wherein the subpixels are light-emitting diodes.

13. The method of claim 10 wherein the array of pixels comprises an array of modules, the modules including a plurality of light-emitting diodes.

14. The method of claim 10 wherein the array of pixels comprises one or more panels including a plurality of light-emitting diodes.

15. The method of claim 10 wherein the process in step (c) for determining the chromaticity and luminance value for each subpixel includes the use of an imaging colorimeter.

16. The method of claim 10 wherein the process in step (d) for storing the chromaticity value and luminance value for each subpixel comprises storing the data in a database.

17. The method of claim 10 wherein the process in step (h) for calculating correction factors for each subpixel includes processing the data using a computer and software.

18. The method of claim 10 wherein the process in step (j) for calibrating the visual display sign further comprises uploading the corrected subpixel values to firmware and/or software controlling the visual display sign.

19. The method of claim 10 wherein steps (a) to (j) take place at the on-site location of the visual display sign.

20. An apparatus for analyzing and calibrating a visual display sign, comprising:

means for capturing an image from a portion of the visual display sign;

means for determining a chromaticity and a luminance value for each of a plurality of subpixels from the captured image;

means for converting the chromaticity values and luminance values for each of the subpixels to measured tristimulus values;

means for converting a target chromaticity value and a target luminance value for a given color to target tristimulus values; and means for adjusting the measured tristimulus values for each subpixel to correspond with the target tristimulus values.

21. The apparatus of claim 20 wherein the means for capturing the image comprises a CCD digital camera and lens, the lens further including optics necessary for long-range imaging.

22. The apparatus of claim 20 wherein the means for capturing the image comprises a CMOS digital camera and lens, the lens further including optics necessary for long-range imaging.

23. The apparatus of claim 20 wherein the means for determining the chromaticity and the luminance values for each of a plurality of pixels comprises software loaded in an interface, the interface being operably coupled to both the capturing means and the visual display sign.

24. The apparatus of claim 20 wherein the means for adjusting the tristimulus values for each subpixel to correspond with the target tristimulus values comprises software for calculating a set of correction factors to be applied to each subpixel and uploading the correction factors to the visual display sign.

25. A method for calibrating a visual display sign having an array of pixels and corresponding subpixels, the method comprising:

(a) locating and registering multiple subpixels of the visual display sign with a flat-fielded imaging photometer;

(b) calculating chromaticity coordinates ($C_x$, $C_y$) and luminance values (L) for each of the registered subpixels;

(c) converting the chromaticity coordinates and luminance values for each registered subpixel to measured tristimulus values ($X_m$, $Y_m$, $Z_m$);

(d) converting a target chromaticity value and a target luminance value for a given color to target tristimulus values ($X_t$, $Y_t$, $Z_t$);

(e) calculating correction factors for each registered subpixel based on a difference between the measured tristimulus values ($X_m$, $Y_m$, $Z_m$) and the target tristimulus values ($X_t$, $Y_t$, $Z_t$), wherein the correction factor for each registered subpixel includes a three by three matrix of values that indicates some fractional amount of power to turn on each registered subpixel for a given color; and (f) sending the correction factors to the firmware and/or software controlling the visual display sign to calibrate the visual display sign with the adjusted data for each registered subpixel.

* * * * *